US006475066B2

(12) United States Patent
Panagian

(10) Patent No.: US 6,475,066 B2
(45) Date of Patent: Nov. 5, 2002

(54) RANDOM-ORBIT HEAD WITH CONCENTRIC LOCK-UP FEATURE

(75) Inventor: Barton Panagian, North Tonawanda, NY (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 11 days.

(21) Appl. No.: 09/793,831

(22) Filed: Feb. 27, 2001

(65) Prior Publication Data

US 2002/0119732 A1 Aug. 29, 2002

(51) Int. Cl.[7] ..... B24B 7/00

(52) U.S. Cl. ..... 451/28; 451/357; 451/343

(58) Field of Search ..... 451/357, 359, 451/343, 28, 270, 271

(56) References Cited

U.S. PATENT DOCUMENTS

| | | | | |
|---|---|---|---|---|
| 3,482,362 A | * | 12/1969 | Bangerter et al. | 451/357 |
| 4,744,177 A | | 5/1988 | Braun et al. | |
| 5,690,545 A | | 11/1997 | Clowers et al. | |
| 5,947,804 A | | 9/1999 | Fukinuki et al. | |

FOREIGN PATENT DOCUMENTS

| | | | | |
|---|---|---|---|---|
| DE | 733899 | * | 4/1943 | 451/357 |

* cited by examiner

*Primary Examiner*—Robert A. Rose

(57) ABSTRACT

An abrasion tool that is selectively configurable for spin or random-orbit without the need for a reversible motor.

2 Claims, 5 Drawing Sheets

RANDOM-ORBIT HEAD WITH CONCENTRIC LOCK-UP FEATURE

BACKGROUND OF THE INVENTION

1. Field of Invention

This invention is directed to a powered too for abrading, grinding, polishing, or the like.

2. Description of the Related Art

The process of finishing surfaces typically requires numerous abrading steps consisting of a first step to roughly grind the surface to an approximation of the desired surface, an intermediate step of smoothing this surface to a near-finished quality, and a final step of polishing the surface to a high degree of smoothness. Typically, the abrasion is provided by a hard, gritty material, which is moved across the surface to be finished. Grindstones and sandpaper are common examples of hard gritty materials used as grinding media. These grinding media are mounted to the sanding head of a powered tool. The sanding heads are driven by a power source that moves the abrading material in a rectilinear motion, a simple spin motion, or a more complex random-orbit motion. Spin motion removes material fast but leaves a surface with swirl marks. Random-orbit motion is slow to remove material but leaves a surface free of swirl marks. An example of an electrically powered spin abrasion tool is U.S. Pat. No. 5,690,545 to Clowers et al. Although the transmission of the power to the sanding head is by means of a flexible shaft the movement of the sanding drive plate is both coaxial and on-axis with the drive shaft. Random-orbit tools differ from spin tools in that the movement of the sanding plate is eccentric, or off-axis, to the drive shaft.

There are known combination tools, which have means for optionally providing either spin or random-orbit motions. U.S. Pat. No. 4,744,177 to Braun et al. is an example of a combination tool. This patent discloses an abrading tool with two eccentricities about the armature shaft. It also has two compensating weights, which automatically position themselves about the eccentric head depending upon the direction in which the armature turns. Alternatively, U.S. Pat. No. 5,947,804 to Fukinuki et al. discloses a similar concept with a reversible motor and weights, which automatically adjust. Typically, these designs are for light duty sanders with a relatively small sanding plate of five or six inches. This size does not lend itself to efficient surfacing of large sheets of artificial stone. There exist standard radial arm polishers that are designed for marble and granite but they do not work well on artificial stone or other solid surface materials as the sanding action is solely from a spin motion and leaves swirl marks that are not acceptable to consumers.

SUMMARY OF THE INVENTION

The present invention relates to an abrasion tool that is capable of being configured for spin or random-orbit motion to finish solid surface materials without the need for an expensive reversible motor as required by the prior art. The tool uses two collars, each having half of the desired offset and half of the counterweight. In spin mode, the collars are rotated so that the counterweights and the offsets cancel each other and the head is balanced and concentric. The sanding plate is coupled to the collars for maximum sanding. This allows coarse sanding with minimal vibrations. In the random-orbit mode, the rotating collar is rotated 180° so that the counterweights are aligned on one side of the axis of spin and the offsets are combined on the opposite side of the axis.

The two collars are pinned to each other but not to the sanding plate. This allows the free rotation of the sanding plate on a shaft while the shaft is driven in an orbital motion. Means is provided for feeding water to the sanding head to assist in finishing those materials that benefit from wet grinding.

DETAILED DESCRIPTION OF THE PREFERRED EMBODIMENTS

Figure 1:
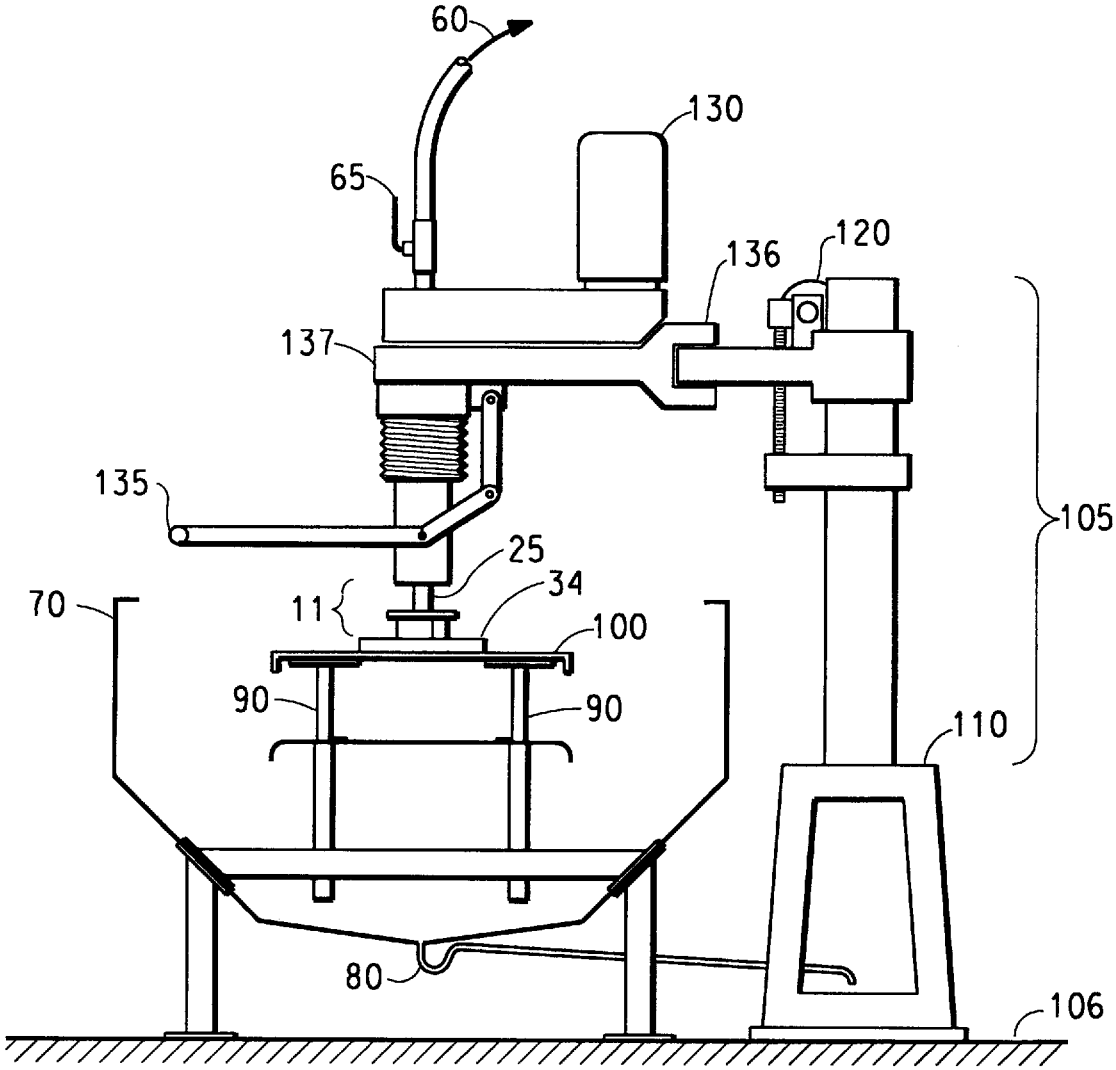
FIG. 1 is an illustration of a radial arm polisher using the sanding head of the present invention.

As shown in FIG. 1, the combination sanding head (11) of the present invention is shown as part of a system to finish a workpiece (100). Although the combination sanding head (11) may be used to good effect in finishing any workpiece, it will find particular use in finishing larger surfaces made of hard stone-like material. The workpiece (100) is mounted on telescoping supports (90) that are located within a splash guard (70). A drain (80) is provided at the bottom of the splashguard to empty any water and grit generated in the finishing operation. The polishing machine (105) is anchored to a suitable mechanical ground (106), preferably a concrete floor. A Park Industries Wizard™ model polishing machine, common in the trade, may be used. Combination sanding head (11) is mounted to the shaft (25) of polishing machine (105). A guidance handle (135) is provided to guide the sanding plate (34) over the surface of the workpiece (100). Sanding plate (34) is mounted on the output shaft (47) of combination-sanding head (11).

Figure 2A:
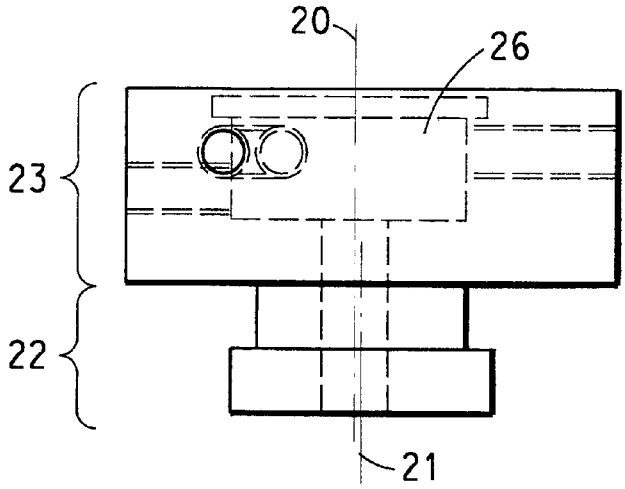
FIG. 2 is an illustration of the upper collar and axes.
Figure 2B:
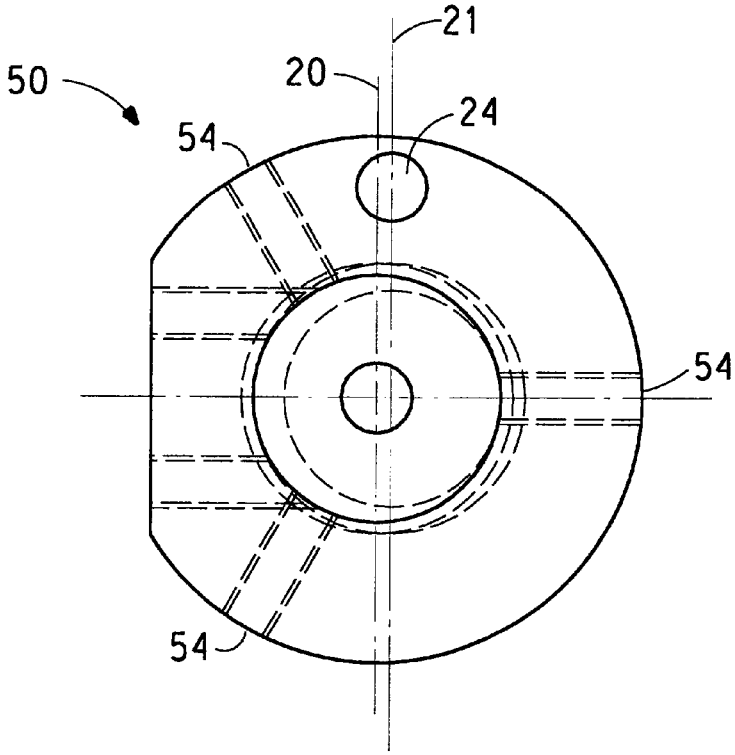

FIG. 2 illustrates the upper collar (50). FIG. 2*a* is a view of the elevation and FIG. 2*b* is a plan view. The upper collar consists of a shaft attachment portion (23) integral to a hub portion (22). The centerline (20) of the shaft attachment bore (26) is offset from the centerline (21) of the hub portion (22). A counterweight (10) is attached to the side of the shaft attachment portion (23) that is proximal to the shaft attachment centerline (20) and distal to the hub portion centerline (21). A through-hole (24) is provided to accommodate lock-up pin (51).

Figure 3A:
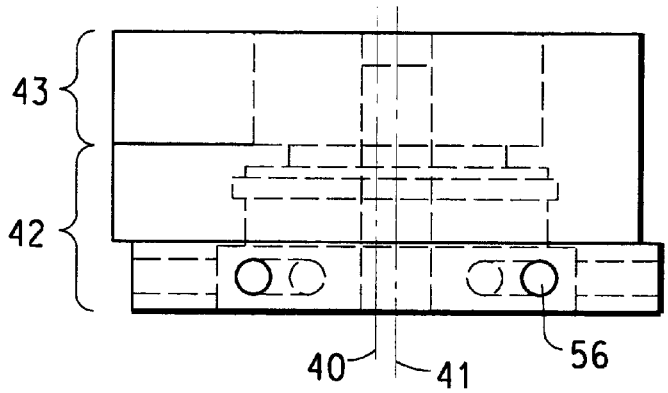
FIG. 3 is an illustration of the lower collar and axes.
Figure 3B:
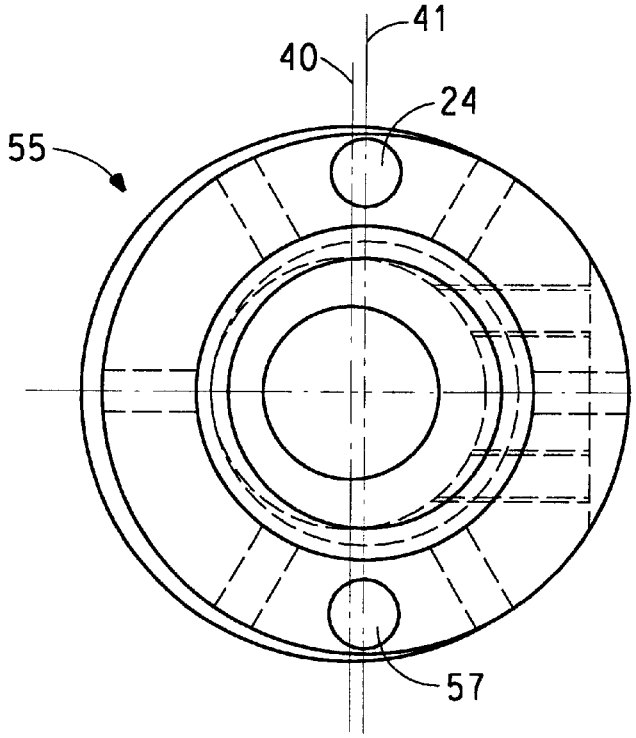

FIG. 3 illustrates the lower collar (55). FIG. 3*a* is a view of the elevation and FIG. 3*b* is a plan view. The lower collar consists of a ball bearing attachment portion (43) integral to a hub portion (42). The centerline (40) of the ball bearing attachment (56) is offset from the centerline (41) of hub portion (42). Oppositely from upper hub (50), a counterweight (15) is attached to the side of the bearing attachment portion (43) that is distal to the bearing attachment centerline (40) and proximal to the hub portion centerline (41). Lower counterweight (15) is of equal weight to upper counterweight (10). The weights depend on the sanding pressure, spindle speed and sanding grit used and are determined empirically. Upper collar (50) and lower collar (55)

are connected by the hub portions (22, 42) that allow relative rotation between the two collars. By rotating upper collar (50) and lower collar (55) about the hub portions (22, 42) the centerline (20) of the shaft attachment can be positioned coaxial to the ball bearing centerline (40) to allow for spin motion, or offset to allow for random-orbit motion. The bearing, such as a standard SKF #5205 A-2RS1/C3 which is a double row ball bearing with seals on both sides, should be rugged enough to withstand any harsh environment expected.

Figure 4:
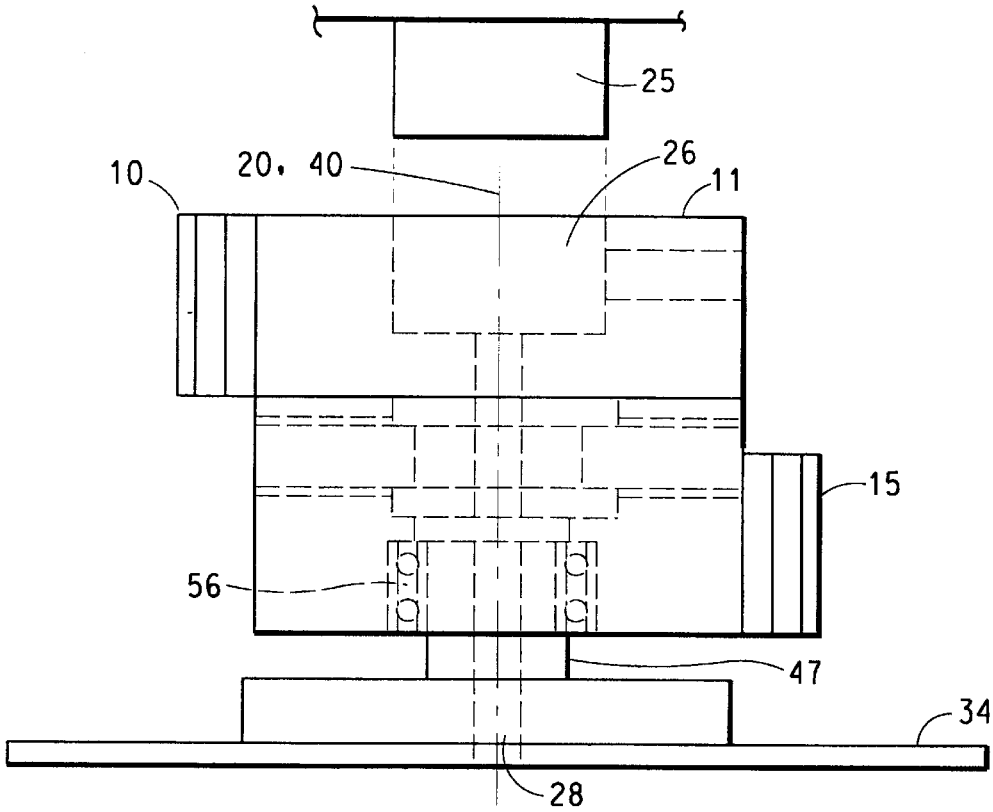
FIG. 4 is an illustration of the sanding head configured in spin mode.

FIG. 4 shows the combination sanding head (11) of the present invention configured for spin mode. The drive shaft (25) of the radial arm polisher fits into shaft attachment bore (26) on upper collar (50) and is secured thereto. A setscrew (54) in a threaded hole will provide a secure attachment. Lock-up pin (51) is provided to couple the sanding plate to collars (50, 55). During spin mode lock-up pin (51) runs through throughholes in both upper and lower collars (50, 55) and rests in a blindhole (58) in sanding plate (34). FIG. 4 shows upper collar (50) and lower collar (55) rotated about hub portions (22, 42) to a position where shaft attachment portions (23, 43) coincide and are coaxial. This alignment will place lower counterweight (15) on the opposite side of axis (20) from upper counterweight (10), thus balancing the counterweights on either side of drive shaft (25). A central bore (28) should be provided through collars (50, 55), hub portions (22, 42) and shafts (25, 47) to allow a cutting fluid, such as water, to flow from a supply source to the surface of sanding plate (34). The water will wash away grit as it is generated in the finishing process as well as reduce heat produced by friction. Other cutting fluids are known but water is preferred for environmental and thermodynamic reasons. Stone finishing creates a harsh environment and the material of construction should be able to withstand it. Stainless steel has been found suitable for all parts except sanding plate (34) which benefits from lower rotational inertia if made from aluminum. Counterweights (10, 15) are preferably of stainless steel plates that are easily stacked to obtain the weight desired.

Figure 5:
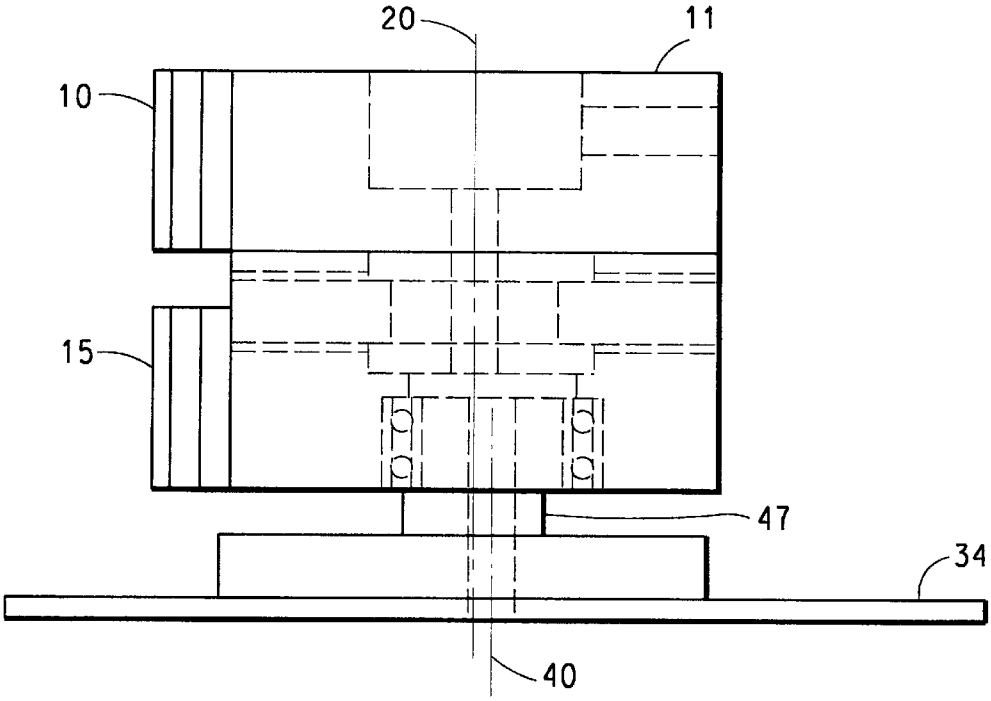
FIG. 5 is an illustration of the sanding head configured in random-orbit mode.
Figure 6:
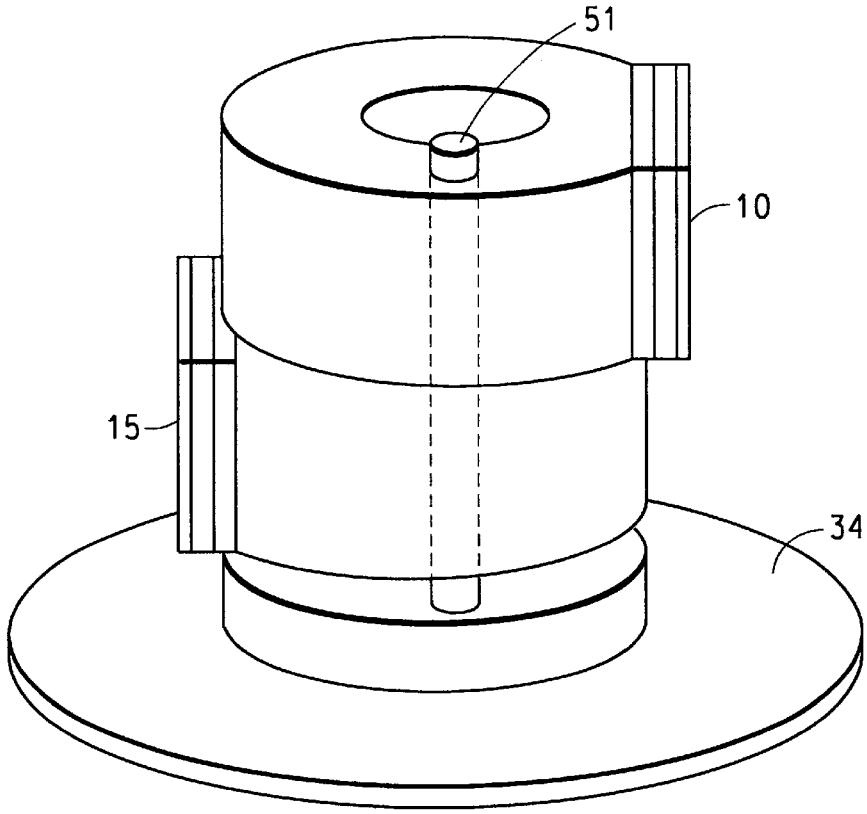
FIG. 6 is an illustration of the sanding head configured in spin mode with the lock-up pin coupling the sanding plate.
Figure 7:
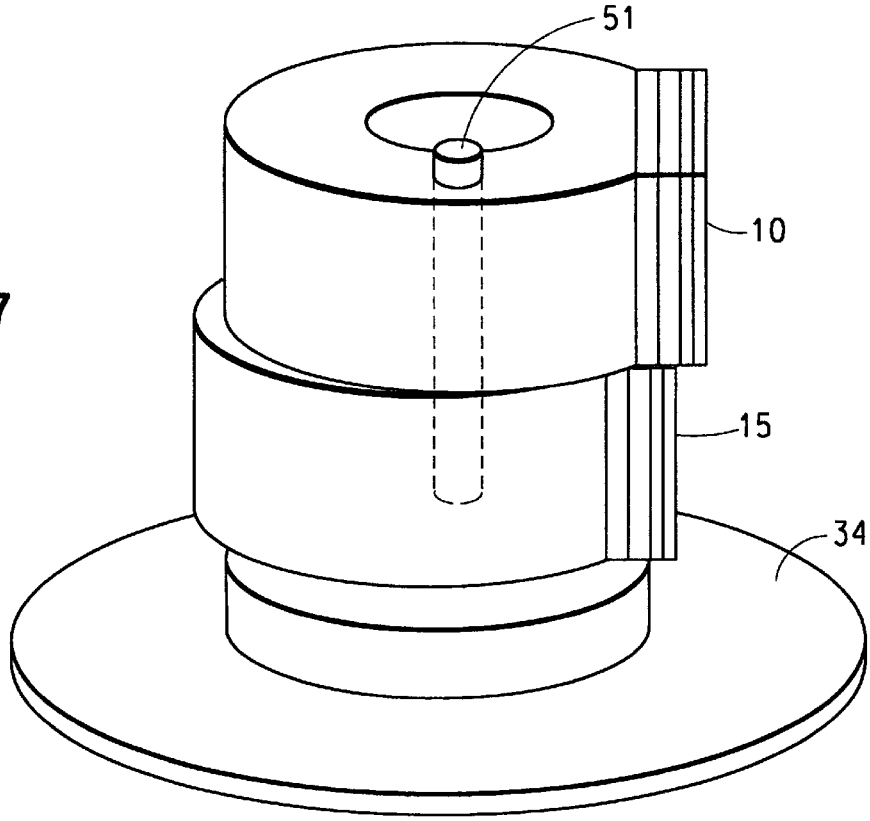
FIG. 7 is an illustration of the sanding head configured in random-orbit mode with the lock-up pin uncoupled from the sanding plate.

FIG. 5. shows sanding head (11) configured for random-orbit motion. Upper collar (50) and lower collar (55) have been rotated about hub (52) until shaft centerline (20) is offset from bearing centerline (40). Concurrently, this will bring both counterweights (10, 15) to a position proximal to drive shaft centerline (20) and distal to bearing centerline (40). This position distal to bearing centerline (40) will balance the counterweights and the load generated by the frictional forces generated while finishing. Lock-up pin (51) is held in a blindhole (57) in lower collar (55). This will mechanically couple the collars but does not engage sanding plate (34). Although it is possible to couple sanding plate (34) to collars (50, 55) during random-orbit mode it leads to objectionable vibrations. FIG. 6 and FIG. 7 better depict the use of lock-up pin (51). FIG. 6 illustrates lock-up pin (51) coupling both collars (50,55) and sanding plate (34). FIG. 7 illustrates lock-up pin (51) coupling both collars (50, 51) but held in lower collar blindhole (57) and not coupled to sanding plate (34). Uncoupling sanding plate (34) during random-orbit operation is found to give superior performance over coupling.

In typical operation, a workpiece (100) to be finished is placed atop telescoping supports (90), which are adjusted to a comfortable working position. A 40-micron diamond sanding disk is affixed to sanding plate (34). Lock-up pin (51) is removed and, using counterweights (10) and (15) as handles and indicators, the collars are rotated to positions where upper counterweight (10) is opposite to lower counterweight (15). Lock-up pin (51) is placed in throughholes (24) and sanding plate blindhole (58). This will set sanding head (11) for spin mode. Motor (130) is turned on and sanding head (11) is guided across the upper surface of workpiece (100) by use of guidance handle (135). Material can be removed from workpiece (100) at a rapid rate using spin mode. This removes highspots from workpiece (100) and an overall smooth and level surface is obtained in an efficient manner. The determination of when the workpiece has attained a sufficiently smooth and level surface can be done by instrument such as a straightedge or by operator discretion. Having obtained a sufficiently smooth and level surface, sanding head (11) can be set for random-orbit mode by raising lockup pin (51) and rotating the collars until counterweights (10) and (15) are inline on the same side of drive shaft (25) and placing the lockup pin in lower collar blindhole (57). Sanding head (11) is again guided across the surface of workpiece (100). Material will be removed from the workpiece at a slow rate while sanding head (11) is set in random-orbit mode. A final polishing is achieved by raising the sanding disk, placing a #7447 Scothbrite ® pad under the disk, lowering the head, and turning on motor (130) while still in random-orbit mode. The workpiece (100) will be polished to a reflective surface, free from swirl marks.

What is claimed is:

1. A combination sanding head selectively capable of spin or random-orbit motion with a non-reversible motor comprising:

(a) an upper collar comprising:
  (i) a shaft attachment with a first centerline;
  (ii) a first hub attachment with a second centerline offset from said first centerline by a distance x; and
  (iii) a first counterweight;

(b) a lower collar comprising:
  (i) a second hub attachment having a third centerline, said second hub attachment rotationally connected to said first hub attachment;
  (ii) a bearing attachment with a fourth centerline offset from said third centerline by said distance x; and
  (iii) a second counterweight;

(c) a sanding plate rotationally connected to said bearing attachment;

(d) a pin selectively capable of coupling said collars to said sanding plate.

2. The combination sanding head of claim 1, further comprising means to conduct a cutting fluid through said upper and lower collars, said hub, said shaft, and said bearing to said sanding plate.

* * * * *